US007018201B1

(12) United States Patent
Pierce et al.

(10) Patent No.: US 7,018,201 B1
(45) Date of Patent: Mar. 28, 2006

(54) DUAL-ZONE DEHYDRATION TUNNEL

(75) Inventors: Brian N. Pierce, Chico, CA (US); Steven Ralph Rasmussen, Yuba City, CA (US)

(73) Assignee: Sunsweet Growers, Inc., Yuba City, CA (US)

( * ) Notice: Subject to any disclaimer, the term of this patent is extended or adjusted under 35 U.S.C. 154(b) by 0 days.

(21) Appl. No.: 11/136,228

(22) Filed: May 23, 2005

(51) Int. Cl.
*F26B 3/04* (2006.01)

(52) U.S. Cl. ..... 432/128; 34/487; 34/500; 34/620; 99/483; 99/477

(58) Field of Classification Search ..... 428/128, 428/129, 133, 239; 34/487, 500, 620; 426/465; 126/21 A; 99/483, 477, 443 C
See application file for complete search history.

(56) References Cited

U.S. PATENT DOCUMENTS 3,107,800 A 10/1963 Gerrans
3,266,559 A 8/1966 Osborne et al.
3,778,221 A * 12/1973 Bloom ..... 432/11
3,802,832 A * 4/1974 Nicolaus ..... 432/128
3,809,530 A 5/1974 Gerrans
4,075,087 A 2/1978 Gerrans
4,221,058 A 9/1980 Zagorzycki
4,472,887 A * 9/1984 Avedian et al. ..... 34/496
4,493,157 A 1/1985 Wicker
4,548,191 A * 10/1985 Hwang ..... 126/21 A
4,587,132 A 5/1986 Fuller, Jr.
4,610,098 A * 9/1986 Duc ..... 34/209
4,948,609 A 8/1990 Nafisi-Movaghar
5,020,237 A * 6/1991 Gross et al. ..... 34/265
5,026,570 A 6/1991 Shibata
5,473,825 A 12/1995 Conselvan et al.
5,613,847 A * 3/1997 Lingl ..... 432/133
5,962,057 A 10/1999 Durance et al.
6,086,933 A 7/2000 Rockstrom
6,183,795 B1 2/2001 Yates
6,268,012 B1 7/2001 Sikora et al.
6,340,494 B1 1/2002 Klukowski et al.
6,484,417 B1 11/2002 Tedman et al.
6,691,526 B1 2/2004 Gether et al.

(Continued)

OTHER PUBLICATIONS

Gentry, J.P. et al.; "Engineering and Fruit Quality Aspects of Prune Dehydration in Parallel- and Counter-Flow Tunnels"; 1965, *Food Technology*, vol. 19, No. 9, pp. 121-125.

(Continued)

*Primary Examiner*—Gregory Wilson
(74) *Attorney, Agent, or Firm*—M. Henry Heines; Townsend and Townsend and Crew, LLP

(57) ABSTRACT

A dehydration tunnel for fruits, vegetables, and other products reduces the vulnerability of the products to damage from carmelization and case hardening by dividing a row of product vessels into two segments, passing heated air simultaneously over both segments but in opposite directions, and advancing the row of vessels unidirectionally through the tunnel. Each vessel is thus exposed to a stream of heated air traversing the vessel in one direction, followed by a separate stream of heated air traversing the vessel in the opposite direction. This allows the tunnel to be operated at moderate temperatures and reduces the harmful temperature cycling of each vessel that is typical of tunnel dryers of the prior art.

25 Claims, 1 Drawing Sheet

U.S. PATENT DOCUMENTS

| | | | |
|---|---|---|---|
| 2001/0015020 | A1 | 8/2001 | Uehara |
| 2002/0029698 | A1 | 3/2002 | van de Vorst et al. |
| 2002/0113132 | A1 | 8/2002 | Shah |
| 2002/0133969 | A1 | 9/2002 | Cassella |
| 2003/0089121 | A1 | 5/2003 | Wilson et al. |
| 2003/0130815 | A1 | 7/2003 | Cohen et al. |
| 2003/0165600 | A1 | 9/2003 | Shefet et al. |
| 2004/0041036 | A1 | 3/2004 | Acker, Jr. |

OTHER PUBLICATIONS

"Dehydration 101: A Basic Look at Dehydration"; 2000, http://www.dryer.com/primer.htm, 6 pages.

* cited by examiner

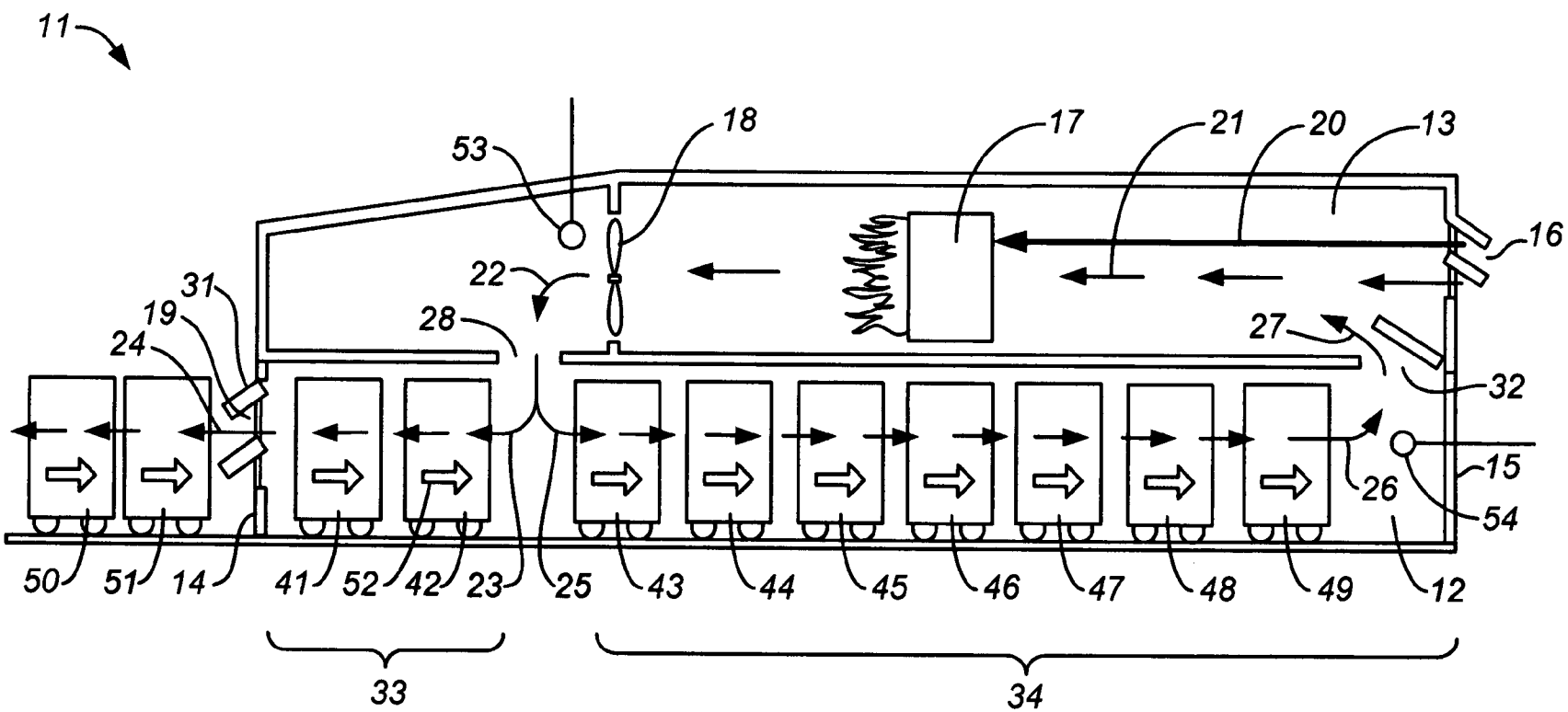
FIGURE

DUAL-ZONE DEHYDRATION TUNNEL

BACKGROUND OF THE INVENTION

1. Field of the Invention

This invention applies to the technology of food processing, and particularly the dehydration of fruits and vegetables. The invention is of particular value in the processing of prunes.

2. Description of the Prior Art

The history of commercial-scale dehydrators for prunes and other foodstuffs begins with natural draft dehydration. This process involved placing the prunes on wooden trays and stacking the trays near a hillside. A fire was lit at the bottom of the hillside to produce a natural draft and the smoke and air passing through the stack drove moisture from the prunes and carried the moisture off as water vapor. Methods of greater sophistication were eventually introduced, notably the use of a box-like dryer in which heat was produced artificially by oil and a large fan forced the heated air across the prunes. Humidity shutters and bleeder vents controlled the flow of moisture entrained by the heated air.

The dehydrators in current commercial use are tunnel dehydrators. Although these dehydrators vary considerably in design, they typically receive product spread on trays which are stacked and placed on wheeled dollies or cars which are advanced through the tunnel where they are exposed to heated air. Each tray has end and center cleats to provide a clearance of about 2.5 inches (about 6 cm) between adjacent trays in a stack, and a car and its tray stack together have a height of approximately 6.5 feet (about 2 m). The dehydrator tunnel accommodates a row of loaded cars, and once placed inside the tunnel, the loaded cars are advanced through the tunnel by rams or other similar conveyors. Each car moves from one end of the tunnel to the other while heated air is passed through the tunnel across the loaded cars. Conveyor belts have also been used in place of the trays and cars.

In the typical drying of prunes that are spread on tray stacks loaded onto cars, the cars move through the tunnel in increments, each increment advancing the cars one car length with the cars remaining stationary for approximately two hours between increments. The passage of air through the tunnel occurs continuously both while the cars are stationary and while they are moving, while the burners are idled down when the cars are ready to be moved. When the cars are moving, the tunnel is opened at both ends to allow a car with fully dehydrated product to be removed from one end and a fresh car with wet product inserted at the other end. Even though the cars are stationary during the air flow, the direction of air flow through the tunnel is a factor in the dehydration efficiency since the moisture level of product in any single car as the heated air flow begins is dependent upon the time that the car has spent in the tunnel which in turn depends on how far the car has advanced in its travel through the tunnel. The dehydration effect of the heated air also depends on the moisture level in the air, which varies with the distance that the air has traveled through the tunnel before reaching any particular car. Thus, dehydration tunnels in which the air flow and the advancement of cars through the tunnel occur in opposite directions are characterized as "counter flow," while those in which the air and the cars move in the same direction are characterized as "parallel flow," even though the cars are stationary while the air is actually flowing over them.

Counter-flow dehydration is the type most commonly used for raisins, and the typical number of cars in a row inside the tunnel is eight to ten cars. Both single-lane and twin-lane tunnels are used. The air at the end at which the cars leave is dry, hot and relatively high in pressure, while the air at the end of the tunnel at which the incoming cars is relatively cool and low in pressure. With each step forward, therefore, a car is exposed to dryer and hotter air until the car is removed from the tunnel.

Parallel flow dehydration is also used, however, particularly in installations having a high throughput rate of product. With both the product and hot air entering the tunnel at the same end, the drying rate at the entry end of the tunnel is very high. Also, product with the highest moisture content is exposed to the warmest air, and the evaporative cooling of the product at this location in the tunnel keeps the product considerably cooler than the air. Parallel flow dehydration is typically used when production requirements outweigh quality concerns.

Among the concerns in dehydration are carmelization, cooking, and case hardening. Carmelization is the burning of sugars in the product and occurs when the temperature and air velocity in the dehydrator are too high. Carmelized product is unfit for commercial sale and cannot be salvaged. "Cooking" is chemical transformation of the oils and sugars in the product due to excessive heat. Although cooked product is not unfit for consumption, the product cannot be returned to an uncooked state. Case hardening, which is likewise caused by excessive temperatures and air velocities but also by low humidity, is the formation of a tough, leather-like outer skin on the product which reduces the ability of moisture to escape the product. Case hardened product can often be salvaged, but only by massive rehydration.

Parallel flow dehydration is particularly vulnerable to each of these undesirable effects, since the introduction of a car with fresh wet product upstream raises the moisture level in the air flowing through the tunnel. Thus, product in the car immediately downstream of the newly introduced car, which was partially dehydrated before the new car was introduced, is rehydrated with moisture from the new car. All cars in the tunnel are similarly affected, and the result is temperature cycling in all cars and in the air contacting the cars, each cycle initiated with each introduction of a fresh car. The cycling repeatedly exposes the product to relatively high temperatures which remain high as the moisture level drops and the product is increasingly vulnerable to damage from the excess heat.

SUMMARY OF THE INVENTION

It has now been discovered that products such as fruits and vegetables can be dehydrated in high volume to a high degree of efficiency and a high yield of quality product by a dual-flow system in which heated air is passed over vessels with moisture-laden product first in one direction and then in the opposite direction. Thus, in a dehydration tunnel that accommodates a row of vessels, air is passed over the row in two streams, one stream passing in a counter-flow direction over a portion of the row that is closest to the entry end of the tunnel, and the other stream passing in a parallel-flow direction over the remainder of the row. A large portion of the moisture, i.e., as much as 50% or more, is thus removed from the product in the portion of the row closest to the entry end (the counter-flow section of the tunnel) before the product is exposed to dry heated air in the portion of the row closest to the exit end (the parallel-flow section tunnel). This change in direction of air flow over a given vessel when passing from the counter-flow section to the parallel-flow section also causes the warmest and driest air in the parallel-flow section to approach each vessel on the side that has the highest moisture content, thereby reducing gradients in the moisture level along the direction of movement of the air flow and the vessels. The moist air leaving the counter-flow section can also be used to pre-heat vessels prior to their entry into the tunnel, since this moist air is still elevated in temperature and has a high heat transfer coefficient due to its high moisture content. This further increases the efficiency of the dehydration process. The pre-heating of the product outside the tunnel and the dual-flow configuration inside the tunnel together reduce the temperature cycling in the tunnel and the attendant risk of damage to the product. A further distinction of note over the prior art system is the changing of the location at which the air exhaust leaves the system. In the prior art system, the exhaust air leaves at the vessel exit end of the tunnel while in the system of this invention, the exhaust air leaves at the vessel entry end. By using the exhaust air to preheat vessels prior to their entry into the tunnel, the system provides to a greater number of vessels the benefit of contact with heated air. In its most preferred embodiments, therefore, the system includes as separate stages a preheating stage and two dehydration stages, one counter-flow and the other parallel-flow.

The air for the counter-flow section and the air for the parallel-flow section preferably originate from a common air stream that enters the tunnel through a single inlet located between the two sections and flows in opposite directions away from the inlet. The relative amounts of air entering the two sections are controlled by variable openings or vents in the tunnel. Also in preferred embodiments of the invention, the tunnel includes a recirculation passage where air emerging from the parallel-flow section is directed back to the point where the heated air enters the tunnel, preferably after being combined with fresh air. Still further preferred embodiments of the invention include humidity detection at one or more points in the system to allow operators to control or adjust the airflow rates, air distributions, temperatures, and any other parameters of the system to achieve humidity values that are characteristic of high-efficiency operation.

Further features, advantages, and preferred embodiments of the invention will be apparent from the description that follows.

BRIEF DESCRIPTION OF THE DRAWING

The FIGURE is a diagram of a dehydration apparatus of the present invention, shown in a vertical cross section.

DETAILED DESCRIPTION OF THE INVENTION AND PREFERRED EMBODIMENTS

Products that can be dehydrated by the process and apparatus of this invention include foodstuffs in general, particularly those where carmelization and case hardening are a concern. These include fruits and vegetables, most notably plums, grapes, apples, apricots, and peaches.

The drying trays in which the product is placed are shallow trays that are typically several square feet in area and a few inches in depth. In one example, the tray has lateral dimensions of approximately 3 ft×6 ft (approximately 1 m×2 m) and a depth of approximately 3 inches (8 cm). As noted above, cleats at the edges and centers of the trays allow them to be stacked with a clearance of about 2.5 inches (6 cm) between trays, and a typical stack contains twenty-six trays. It is emphasized that these numbers are simply examples; the invention is applicable to systems with larger or smaller trays and greater or lesser numbers of trays in a stack.

An example of a dehydration tunnel in current use for parallel-flow dehydration is one that accommodates nine tray stacks on wheeled dollies or cars. Such a tunnel can be converted for use in the practice of the present invention by appropriate modifications to the doors and openings in the tunnel and the placement of additional openings, as will be described in detail below and shown in the Figure. In general, the tunnel is preferably sized to accommodate as many as twenty-six tray stacks on cars in a single row. The invention is also capable of implementation in tunnels with two or more lanes, each lane accommodating an individual row with air streams that are independent from those of other lanes. The term "linear array" is used herein to denote an individual row and the advancement of the cars from one position in the row to the next. The array may be a straight line or a curved line, although a straight line is the most practical and thus preferred. The term "vessel" is used herein to represent the car with the tray stack mounted on the car. Substitutes for the car-mounted tray stacks are bins, conveyor belt segments, and any other support or receptacle that can be advanced through the tunnel and can be loaded with product in an exposed manner for contact with an air stream. All such supports and receptacles are encompassed within the term "vessel."

The directions of the air streams, their sites of introduction, and the desired amount of exposure time of the product to the heated air at each stage of the dehydration, determine the lengths of the tunnel sections, and hence the number of vessels, in which counter-flow and parallel-flow dehydration, as these terms are defined above, occur. In general, the counter-flow section will contain at least one, but less than all, of the vessels, with the remainder in the parallel-flow section. In preferred embodiments, the parallel-flow section accommodates a greater number of vessels than the counter-flow section. With vessels of the size typically used in prune processing, the number of vessels in the counter-flow section is preferably from 1 to 4, more preferably 2 to 3, and most preferably 2, while the number of vessels in the parallel-flow section is 3 to 12, more preferably 5 to 10, and most preferably 7 or 8. In certain embodiments, a maximum of three vessels are accommodated in the counter-flow section and a minimum of five vessels in the parallel-flow section.

Carmelization and case hardening result when the rate of moisture migration to the surface of the product is exceeded by the rate evaporation at the surface. The temperature of the heated air entering the parallel-flow section is therefore maintained low enough to prevent these undesirable results and yet high enough to promote the evaporation of water from the product. In the counter-flow section, the contact of the product with the heated air preferably raises the temperature of the product to within 10 to 20 degrees F. (about 5.5 to 11 degrees Celsius) of the temperature of the heated air first entering this section. In most cases, efficient results will be achieved when this temperature is from about 165° F. to about 180° F. (74–82° C.). In embodiments where two vessels are placed in the counter-flow section, the heated air initially passes through the vessel in the second position, where it absorbs a large quantity of moisture. The air leaving the vessel in the second position therefore has a high moisture content which enables this air to transfer heat very quickly to the vessel in the first (i.e., entry) position. The exhaust air from the first position, having passed through both the second and first vessels, preferably has a relative humidity of from about 60% to about 90%. As noted above, this air can be used for pre-heating additional vessels and their contents before those vessels enter the tunnel. In the typical systems contemplated herein, from two to four vessels can be preheated in this manner.

Operating conditions inside the tunnel, and preferably at two or more different locations in the tunnel or the recirculation passage, can be monitored and controlled to prevent, reduce, or minimize any occurrences of case hardening, cooking, and carmelization. One method of monitoring the operation of the tunnel is by monitoring the humidity of the air. Humidity can for example be monitored immediately downstream of the parallel-flow section and in the air stream or streams entering the two tunnel sections. In a presently preferred embodiment, the target relative humidity range in the air stream entering the two tunnel sections is 25% to 35%, and difference between the humidity at this location and the humidity at the downstream end of the parallel-flow section is used to determine when adjustments are to be made, for example by varying the amount of fresh air that is admitted into the system. Localized humidity detection can be achieved by any of a wide variety of humidity sensors. Examples are wet bulb/dry bulb pychrometers, displacement sensors, bulk polymer resistive sensors, organic polymer capacitative sensors, optical dew point hygrometers, electrolytic hygrometers, and piezo-resonance sensors. All such sensors are available from commercial suppliers.

When the humidity at any monitored location deviates from the target range, the operating conditions in the tunnel can be adjusted by changing any of the system parameters that affect these conditions. Thus, the total air flow rate, the heating rate and air temperature, the relative amounts of heated air passing through the counter-flow and parallel-flow sections, and the amount of wet air released through exhaust can all be varied, either individually or in combination.

Air flow through both sections of the tunnel can be achieved by conventional means such as fans or blowers, or by supplying air from a source of compressed air. Air itself is not required; any moisture-free or low-moisture gas that is inert to the product under the conditions of the dehydration operation can be used. These include nitrogen, oxygen-depleted air, or any inert gas. Air is preferred for purposes of convenience. Heating of the air prior to its entry into the two sections of the tunnel can likewise be achieved by conventional means. Examples are resistance heaters, gas burners, and oil-based heaters.

The two air streams can be supplied by separate sources of air or separate supply lines. It is preferred however that the two air streams be supplied by a common air inlet, with the air emerging from the inlet being divided into the two streams within the tunnel. This division of a single stream into two streams and control of the volume of one stream relative to the other can be achieved by conventional flow control methods, such as baffles, adjustable vanes, or similar flow-directing devices, by orifices or passageways of selected cross section, or by controlling the rate of escape of air from either of the two sections of the tunnel.

The vessels are advanced through the tunnel in unidirectional manner, entering at one end of the tunnel and leaving at the other after passing first through the counter-flow section and then through the parallel-flow section. Advancement is preferably performed in the manner of the prior art, i.e., in increments of which each increment is the distance from the leading edge of one vessel to the leading edge of the next vessel. Between increments, therefore, the vessels are at predetermined stations along the length of the tunnel, and during each increment of movement, the vessels advance from one station to the next. Advancement is preferably achieved by mechanical means, either by linking the vessels together in a chain and pulling the chain from the front or by pushing the column of vessels from the rear, as for example with a hydraulic or pneumatic ram. Air movement may continue while the vessels are moving, but the burners (or heating element in general) are preferably turned off or turned down. Also during the movement, doors at the entrance of the tunnel are opened to admit a vessel with fresh product to be dehydrated, and doors at the exit of the tunnel are opened to allow removal of a vessel with fully dehydrated product. Once the vessels reach the next station, the doors are closed and all other components are returned to full operation. The time interval between movement of the vessels, i.e., the period of exposure of a vessel at each station to moving heated air, will vary depending on the choice of product, the volume of product being dehydrated, the desired degree of dehydration, and other parameters of the system. In most cases, intervals of from about 30 minutes to about 3 hours, and preferably from about 1 hour to about 2 hours, will provide the desired results.

The features that characterize this invention can be implemented in a wide variety of configurations and embodiments. The Figure hereto depicts one such embodiment and is described below.

The drying apparatus 11 in this Figure includes a dehydration tunnel 12 with a recirculation passage 13 (hereinafter referred to as a "mezzanine"), a vessel entry door or inlet 14 (shown in a closed position), a vessel exit door or outlet 15 (also shown in a closed position), an air intake opening 16, a burner 17 to heat the incoming air, a fan 18, and an exhaust vent 19. Combustion air 20 for the burner is supplied from atmospheric air. The travel of dehydration air through the apparatus is indicated by single-line arrows 21, 22, 23, 24, 25, 26, 27, and begins with the fan 18 drawing atmospheric air into the mezzanine 13 through the air intake opening 16 to pass through the burner 17. Heated air from the fan exhaust then passes through an opening 28 in the floor of the mezzanine to enter the dehydration tunnel 12. In the tunnel, the air is divided into two streams 23, 25. One stream 23 travels toward the vessel entry door to leave the tunnel in an exhaust stream 24 that passes through open vents 31 in the vessel entry door, while the other stream 25 travels toward the vessel exit door 15. Since the vessel exit door 15 does not contain vent openings and is closed during the air movement, the air 26 approaching the vessel entry door passes through an opening 32 in the floor of the mezzanine above to enter the mezzanine where it joins the incoming fresh air.

The location of the upstream opening 28 in the mezzanine floor through which air enters the tunnel 12 divides the tunnel into the counter-flow section 33, in which the direction of air travel is toward the vessel entry door 14, and the parallel-flow section 34, in which the direction of air travel is toward the vessel exit door 15. A total of nine vessels 41, 42, 43, 44, 45, 46, 47, 48, 49 are shown in the tunnel 12, plus two vessels 50, 51 outside the tunnel entrance 14. Of the vessels inside the tunnel, two 41, 42 are positioned in the counter-flow section 33 and the remaining seven 43, 44, 45, 46, 47, 48, 49 in the parallel-flow section. The direction of movement of each vessel between periods of air flow is shown by the series of outlined arrows 52, one shown on the face of each vessel. Humidity is monitored by sensors at two locations within the system. One sensor 53 is located at the exhaust of the fan 18 and the other 54 is located at the downstream end of the parallel-flow section 34. The distribution of air between the counter-flow section 33 and the parallel-flow section 34 is controlled by an adjustable door 54 at the opening 32 in the mezzanine floor through which air leaves the parallel-flow section 34. The two vessels 50, 51 outside the entry door to the tunnel are preheated by hot wet air emerging from the tunnel exhaust vent 19.

The foregoing is offered primarily for purposes of illustration and is not intended to limit the scope of the invention. Further variations in the system components, configurations, arrangements, and operating conditions will be readily apparent to those skilled in the art and can be made without departing from the spirit and scope of the invention.

What is claimed is:

1. Apparatus for dehydrating a product retained in vessels, said apparatus comprising:

a tunnel comprising an interior sized to receive a plurality of said vessels in a linear array, a vessel inlet at a first end of said tunnel and a vessel outlet at a second end of said tunnel, said vessel inlet and vessel outlet defining a direction of movement of said vessels through said tunnel, said tunnel interior comprising a first section adjacent to said vessel inlet and sized to receive at least one but less than all of said plurality of vessels and a second section adjacent to said vessel outlet and sized to receive all remaining vessels of said plurality, and said tunnel further comprising air flow means for passing a first stream of air through said first section toward and out of said vessel inlet and a second stream of air through said second section toward said vessel outlet simultaneously with, and in a direction opposite to, said first stream; and vessel conveying means for unidirectionally advancing vessels within said tunnel along said direction of movement and through said first and second sections in succession.

2. The apparatus of claim 1 wherein said air flow means comprises a single air inlet positioned to introduce air between said first and second sections, said apparatus further comprising an air recirculation passage arranged to receive air emerging from said second section and directing air so received to said air inlet.

3. The apparatus of claim 2 wherein said air flow means further comprises a variable opening between said tunnel interior and said recirculation passage.

4. The apparatus of claim 2 wherein said air flow means further comprises an air blower and an air heater.

5. The apparatus of claim 2 further comprising a first humidity sensor at said air inlet and a second humidity sensor at a site downstream of said second section.

6. The apparatus of claim 1 further comprising a plurality of said vessels of selected dimensions, and wherein said first section is sized to receive from 1 to 4 of said vessels and said second section is sized to receive from 3 to 12 of said vessels.

7. The apparatus of claim 1 wherein said second section is sized to receive a greater number of said vessels than said first section.

8. The apparatus of claim 1 further comprising means for determining the humidity of air entering said first and second sections.

9. The apparatus of claim 1 further comprising a tunnel entry door at said vessel inlet that when open permits entry of one of said vessels, and a tunnel exit door at said vessel outlet that when open permits exit of one of said vessels, said tunnel entry door containing adjustable vanes to permit air to escape.

10. A process for the dehydration of a product retained in vessels, said process comprising:

placing a plurality of said vessels in a linear array in a tunnel having a vessel inlet at a first end of said tunnel and a vessel outlet at a second end of said tunnel, said tunnel comprising a first section adjacent to said vessel inlet and a second section adjacent to said vessel outlet;

feeding heated air to said tunnel in first and second streams simultaneously to cause said first stream to flow through said first section toward said vessel inlet and out of said tunnel through said vessel inlet, and said second stream to flow through said second section toward said vessel outlet, said streams causing dehydration of said product; and advancing said linear array of vessels together through said tunnel to cause individual vessels to pass through said first and second sections in succession.

11. The process of claim 10 wherein each vessel has a leading edge defined by the direction of advancement of said linear array, and said process comprises advancing said linear array in increments, each increment being equal in length to the distance between the leading edge of one vessel and the leading edge of an adjacent vessel, while adding a vessel to said array through said vessel inlet and removing a vessel through said vessel outlet at each increment.

12. The process of claim 11 further comprising closing said vessel inlet and said vessel outlet between increments while leaving vent openings in said vessel inlet to permit the release of moisture-laden air.

13. The process of claim 12 further comprising recycling at least a portion of said second stream to said air inlet through an opening in said tunnel wall downstream of said second section.

14. The process of claim 11 comprising feeding said heated air to said tunnel in said first and second streams simultaneously for intervals of from about 30 minutes to about 3 hours between said increments.

15. The process of claim 10 comprising feeding said heated air through a common opening in a wall of said tunnel to thereby inject said heated air between said first and second sections.

16. The process of claim 12 further comprising recycling at least a portion of said second stream to said common opening.

17. The process of claim 12 further comprising preheating said vessels prior to placing said vessels in said tunnel, by contacting said vessels with air leaving said first section.

18. The process of claim 10 further comprising recycling at least a portion of said second stream.

19. The process of claim 10 wherein said second section is greater in length than said first section and said process comprises placing a greater number of vessels in said second section than in said first section.

20. The process of claim 10 comprising placing a maximum of three of said vessels in said first section and a minimum of five of said vessels in said second section.

21. The process of claim 10 wherein said product is plums.

22. The process of claim 10 wherein said product is grapes.

23. The process of claim 10 wherein said product is apricots.

24. The process of claim 10 wherein said product is apples.

25. The process of claim 10 wherein said product is peaches.

* * * * *

UNITED STATES PATENT AND TRADEMARK OFFICE

CERTIFICATE OF CORRECTION

PATENT NO. : 7,018,201 B1
APPLICATION NO. : 11/136228
DATED : March, 28, 2006
INVENTOR(S) : Brian N. Pierce et al.

It is certified that error appears in the above-identified patent and that said Letters Patent is hereby corrected as shown below:

In column 7, beginning at line 1 change "door 54 at the opening" to --door at the opening--

Signed and Sealed this

Twenty-fifth Day of July, 2006

JON W. DUDAS
*Director of the United States Patent and Trademark Office*